US008157144B2

(12) United States Patent
Andersson et al.

(10) Patent No.: US 8,157,144 B2
(45) Date of Patent: Apr. 17, 2012

(54) STAPLER

(75) Inventors: Mats Andersson, Mullsjö (SE); Mattias Palmquist, Hestra (SE); Trygve Gustafsson, Senhöga (SE); Per-Åke Högberg, Senhöga (SE); Martin Elonsson, Huskvarna (SE)

(73) Assignee: Isaberg Rapid AB, Hestra (SE)

( * ) Notice: Subject to any disclaimer, the term of this patent is extended or adjusted under 35 U.S.C. 154(b) by 0 days.

(21) Appl. No.: 11/628,784

(22) PCT Filed: Jun. 7, 2005

(86) PCT No.: PCT/SE2005/000852

§ 371 (c)(1),
(2), (4) Date: Dec. 7, 2006

(87) PCT Pub. No.: WO2005/120779

PCT Pub. Date: Dec. 22, 2005

(65) Prior Publication Data

US 2007/0241162 A1 Oct. 18, 2007

(30) Foreign Application Priority Data

Jun. 10, 2004 (SE) ..... 0401475

(51) Int. Cl.
*B25C 5/15* (2006.01)

(52) U.S. Cl. ..... 227/131; 227/156

(58) Field of Classification Search ..... 227/125, 227/131, 155, 156; 74/53, 55; 192/150
See application file for complete search history.

(56) References Cited

U.S. PATENT DOCUMENTS

| | | | | |
|---|---|---|---|---|
| 4,199,095 | A * | 4/1980 | Yamanoi | 227/125 |
| 4,641,772 | A | 2/1987 | Skuthan | |
| 5,088,370 | A * | 2/1992 | Kondo | 83/528 |
| 5,413,266 | A * | 5/1995 | Jairam | 227/129 |
| 5,702,047 | A * | 12/1997 | Yoshie | 227/131 |
| 6,135,337 | A | 10/2000 | Harris et al. | |
| 6,616,029 | B1 * | 9/2003 | Andersson | 227/155 |
| 6,769,592 | B2 * | 8/2004 | Strååt | 227/131 |
| 6,820,790 | B2 * | 11/2004 | Ura | 227/131 |

FOREIGN PATENT DOCUMENTS

| | | |
|---|---|---|
| EP | 0 530 855 A2 | 3/1993 |
| EP | 0 579 118 A1 | 1/1994 |
| EP | 1 177 869 A1 | 2/2002 |

* cited by examiner

*Primary Examiner* — Rinaldi Rada
*Assistant Examiner* — Nathaniel Chukwurah
(74) *Attorney, Agent, or Firm* — Miles & Stockbridge P.C.

(57) ABSTRACT

A stapler has a drive train that drives a stapling head toward a base part in a driving stroke and away from the base part in a return stroke. To accommodate thick workpieces to be stapled, without jamming, the drive train includes a coupling constructed so that its effective connection between coupled parts is releasable and so that it loses its effective connection during the driving stroke to prevent jamming.

6 Claims, 15 Drawing Sheets

P
1
2
3
5
6
7
8
9
10
11
12
13

N
5
2
9
8
7
26
20
25
23
27
21
22
28
30
24
D
d 5
8
7
21
20
19
25
30
28
29

STAPLER

TECHNICAL FIELD

The present invention relates to a stapler for stapling a workpiece, especially a sheaf of papers, which stapler comprises a base part and a stapling head which are connected together by a connecting means in such a way that they can move towards and away from one another in a reciprocating stapling movement which has a first turning point and a second turning point, which stapling head accommodates staples and a driver which is supported for sliding in the direction of the stapling movement and which in the course of the stapling movement drives a staple into the workpiece which is to be stapled, and said stapler also comprises a drive means which, in the course of a driving stroke which forms part of the stapling movement, starting from a point at which the stapling head and the base part are at a distance from one another, drives the stapling head and the base part towards one another to the second turning point at which the stapling head and the base part are at their shortest distance from one another and are in clamping contact with the workpiece, and thereafter drives the driver to said second turning point, during which driving a staple is driven into the workpiece, after which the parts perform a return stroke which brings them back to the starting point, wherein the drive means also comprises an activating arrangement which is in connection via a first coupling to the stapling head and the driver and via a second coupling to the base part in such a way that during the stapling movement the activating arrangement varies the distance between the first and second couplings from a first extreme position in which the stapler is at the first turning point of the stapling movement to an opposite second extreme position in which the stapler is at the second turning point of the stapling movement.

STATE OF THE ART

Staplers of the kind indicated above are previously known. However, the disadvantage of those previous staplers is that when too thick a sheaf of papers has to be stapled it may happen that during the stapling movement the stapler cannot reach the second turning point and thereafter be driven to the starting point, causing the stapler to jam, with the result that the drive means becomes overloaded and only with difficulty can the sheaf of papers be removed from the stapler. To solve this problem, a stapler in which the second turning point is made flexible was proposed in EP 0 322 906. However, such a solution has not proved to be sufficient in such cases as the stapling of an overdimensioned workpiece.

PROBLEM

There is thus a need to create a stapler which does not become jammed such that the stapling movement cannot be performed in such a way that the starting point is reverted to, or which becomes overloaded or which only after the exertion of great force returns to the starting position.

SOLUTION

The invention now proposed provides a solution to the stated problem with a stapler of the kind described above which is characterised in that at least one of the couplings is releasable and is so arranged that in the course of the driving stroke it changes to a position in which it loses its effective connection in the stapling movement direction if the driving stroke cannot reach the second turning point.

The present invention is further characterised in that said coupling resumes effective connection when the driving stroke changes to the return stroke.

The present invention is still further characterised in that the first turning point has a certain position and that the coupling, when the return stroke reaches the turning point, is brought to a position where there is effective connection in the course of the driving stroke.

The present invention is also characterised

- in that the releasable coupling comprises first coupling surfaces in connection with the base part and second coupling surfaces in connection with the stapling head/driver, which coupling surfaces engage with one another in such a way that at a first engaged position they form a connection which functions in the course of the driving stroke, and at a second engaged position they lack such a connection;
- in that a flexible latching means is disposed between these positions;
- in that the engagement of the surfaces changes from the first position to the second position as a result of the first coupling surfaces passing the latching means if the driving stroke cannot reach the second turning point.

The present invention is moreover characterised in that the first coupling surfaces are arranged on a spigot fitted to the base part, and the second coupling surfaces are adapted to an elongate slot arranged in a drive link which is incorporated in the activating arrangement and is in connection with the stapling head/driver.

BRIEF DESCRIPTION OF DRAWINGS

The invention is hereinafter described with reference to the attached drawings, in which.

PREFERRED EMBODIMENT

Figure 1:
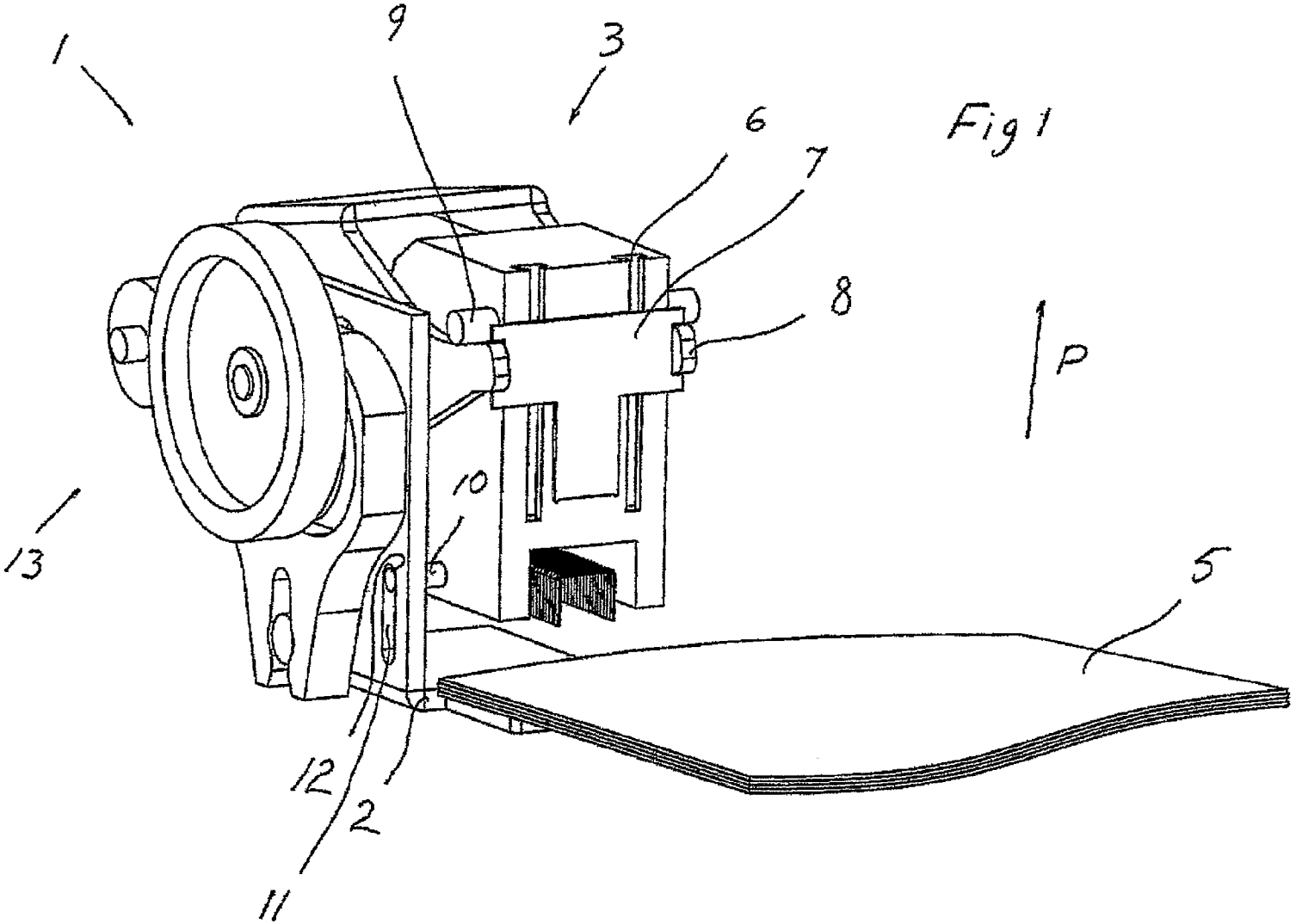
FIGS. 1-3 are schematic views of a stapler according to the present invention, in which the stapler is in different positions in the course of a stapling movement.
Figure 2:
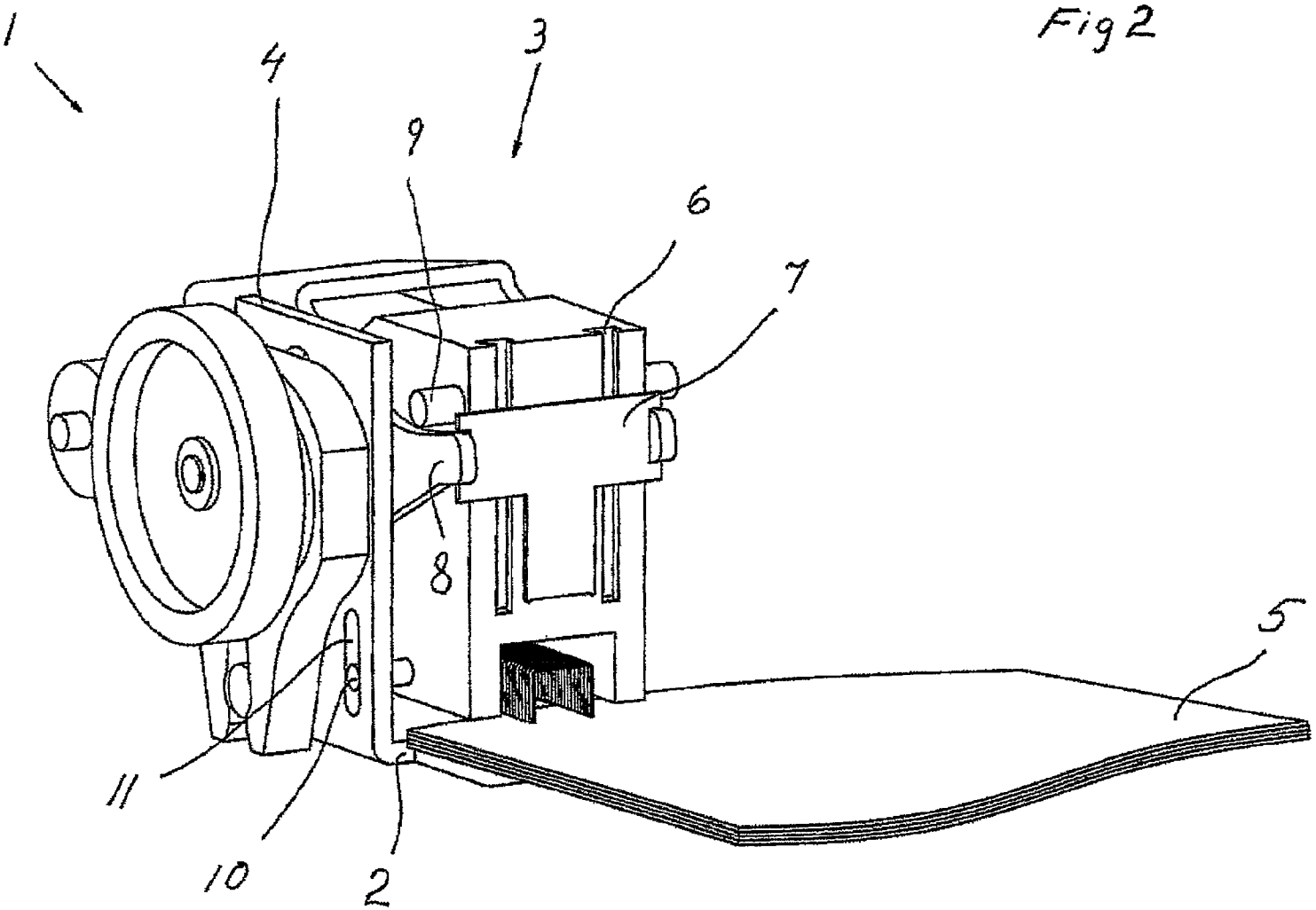
Figure 3:
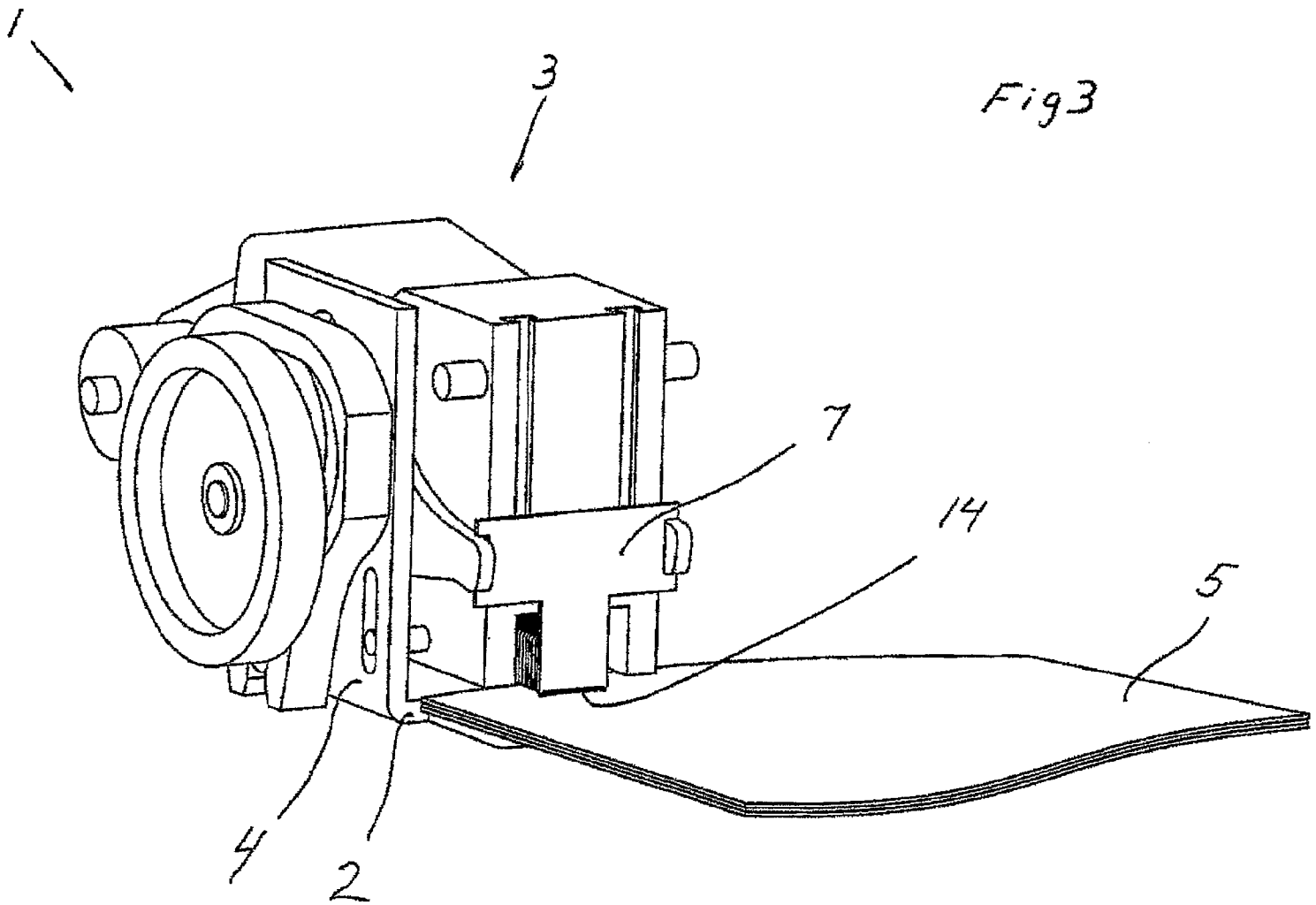

FIGS. 1-3 depict a stapler 1 which comprises a base part 2 and a stapling head 3. The stapling head and the base part are connected by a connecting means 4 which in a known manner by means of an undepicted first guide arrangement connects the base part and the stapling head in such a way that in the course of a reciprocating stapling movement they can move towards and away from each other, the direction of which movement is represented by the double arrow P. A workpiece 5 intended for stapling, which may especially take the form of a sheaf of papers, is placed on the base part. A driver 7 which, by means of drive arms 8 adapted to the stapling head, can move up and down in the course of the stapling movement P is adapted to the stapling head by means of a second guide arrangement 6. An upper boss 9 and a lower boss 10 are also disposed in the stapling head. A long hole 11 into which the lower boss 10 extends is provided in the connection means 4. In FIG. 1, in which the stapler is depicted at a position in which the stapling movement is at a first turning point, further movement of the base part and the stapling head/driver away from each other is prevented by the bosses 9 and 10 in that the boss 10 enters into engagement with an end portion 12 of the long hole 11 and the boss 9 enters into engagement with the drive arm 8. The drawings also depict a drive means 13 whose construction and function are explained in the description below. The drawings further show the stapling head containing staples 14, and they also show schematically that the latter are driven by the driver 7 into the workpiece 5 during a stapling movement.

FIGS. 5-8 depict the stapler 1 as seen from the side. They show the drive means 13, which comprises a drive motor 15, the drive arms 8, only one of which is depicted, and an activating arrangement 16. The drive arms are coupled pivotably to the stapling head by a pivot spigot 17 and can move up and down about the pivot spigot 17 in the stapling movement direction P.

Figure 4:
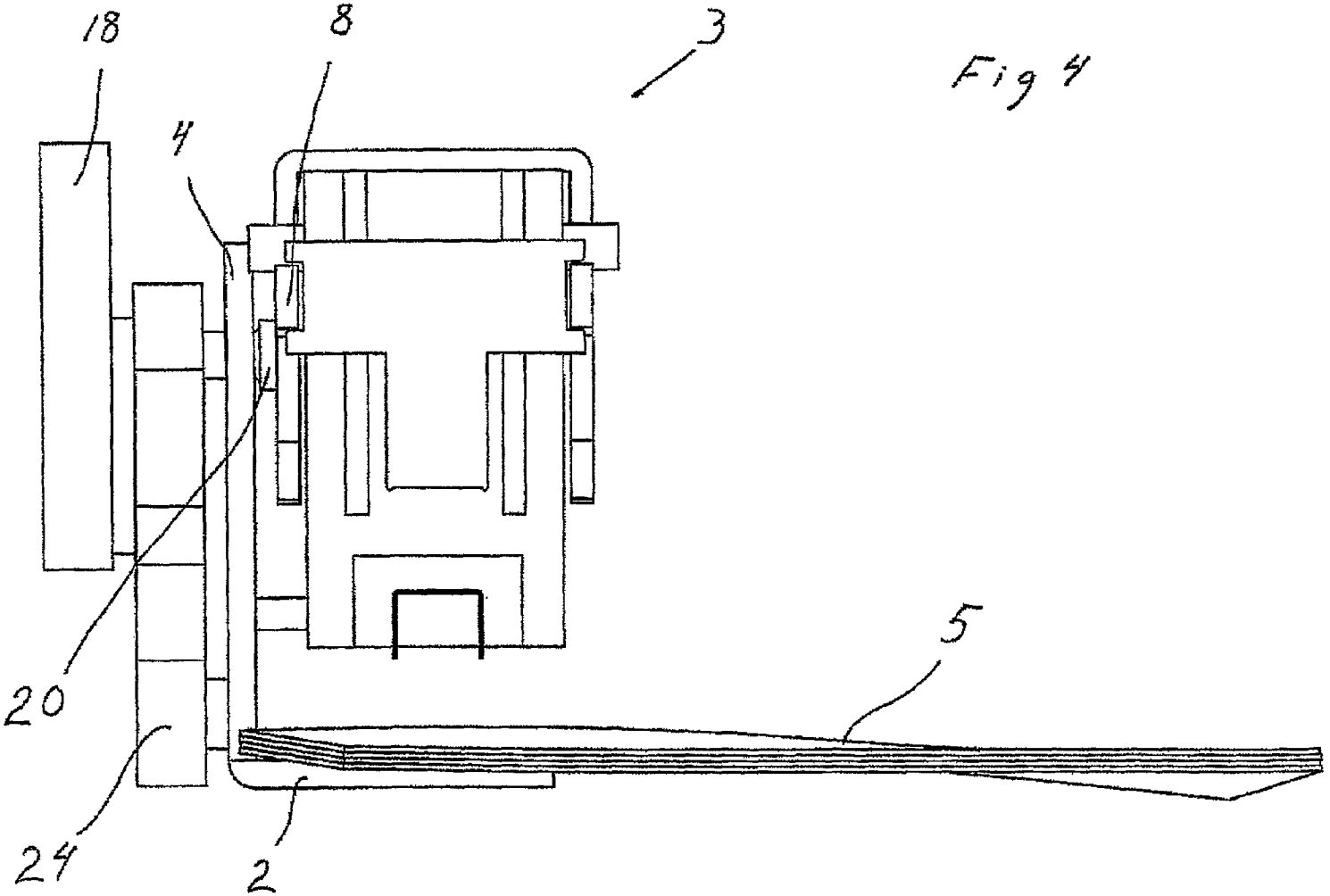
FIG. 4 is a schematic view of a stapler as seen from in front.

The activating arrangement comprises a flywheel 18 which, as depicted in FIG. 4, is rotatably connected to a drive arm 8 by a first coupling 19 which comprises a rotation spindle 20. A pulley 21 represented in the drawings by chain-dotted lines and with its centre 22 situated eccentrically relative to the rotation centre 23 of the rotation spindle 20 is disposed on the flywheel. An activating link 24 provided with a rectangular aperture 25 which surrounds the pulley 21 and which, when concealed, is represented by broken lines is connected to the pulley 21, the short sides 26,27 of the rectangular aperture being semicircular in shape with a diameter D slightly larger than the diameter d of the pulley. The activating link 24 is also coupled by a second coupling 28 to the base part 2, which coupling comprises a slot 29 arranged in the link 24, which recess is coupled to a spigot 30 which is connected to the base part 2. A transmission which is not depicted in the drawings but which in the course of the stapling movement drives the flywheel in a clockwise direction indicated by the arrow M is arranged between the drive motor 15 and the flywheel 18 in a manner known to one skilled in the art.

A stapling movement during the stapling of a workpiece is hereinafter described with reference to FIGS. 5-7. When the stapler is at the position depicted in FIG. 5, the stapler is at a first turning point at which the base part and the stapling head/driver are in an extreme position and at their longest distance from the respective couplings 19, 28, and the interaction which takes place between the boss 9 and the drive arm 8 and between the boss 10 and the end portion 12 results in this turning point assuming a certain position. In FIG. 6 the flywheel, in the first stage of a driving stroke of the stapler in a direction represented by the arrow N, has been rotated a quarter-turn and the pulley 21, by its interaction with the aperture 25 in the activating link 24, has moved the spigot 30 closer to the rotation spindle 20. The fact that the friction between the driver 7 and the stapling head 3 is greater than the function prevailing in the guide arrangement of the connecting means therefore results at this stage in the stapling head and the base part being driven towards one another to the situation depicted in FIG. 6. In this situation the base part and the stapling head are at the second turning point and the base part and the stapling head are, each on their respective side, in clamping contact with the workpiece 5.

Figure 7:
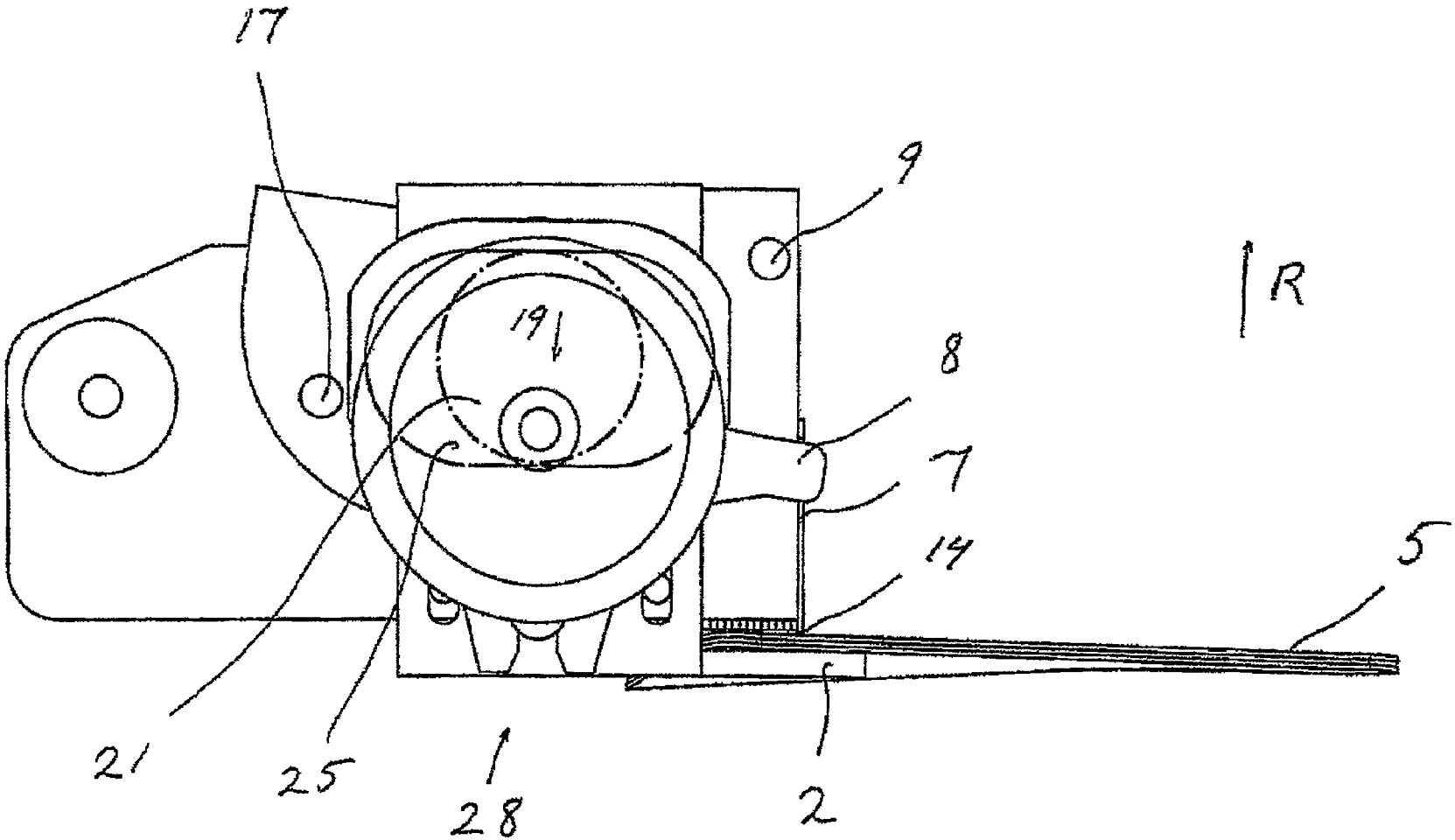

Thereafter the flywheel is rotated further in a second stage of the driving stroke by a quarter-turn to the situation depicted in FIG. 7, in which the interaction of the pulley 21 and the aperture 25 has moved the spigot 30 still closer to the spindle 20, and the respective couplings 19 and 28 are now at the second extreme position and the driver 7 has now been driven by the drive arms 8 down towards the workpiece 5, resulting in a staple 14 having been driven into the workpiece 5. In this situation the stapler is at the second extreme position and the second turning point, in both of which positions the couplings 19, 28 are at their shortest distance apart during the stapling movement. This position may vary within certain limits, depending on the thickness of the workpiece being stapled.

Figure 5:
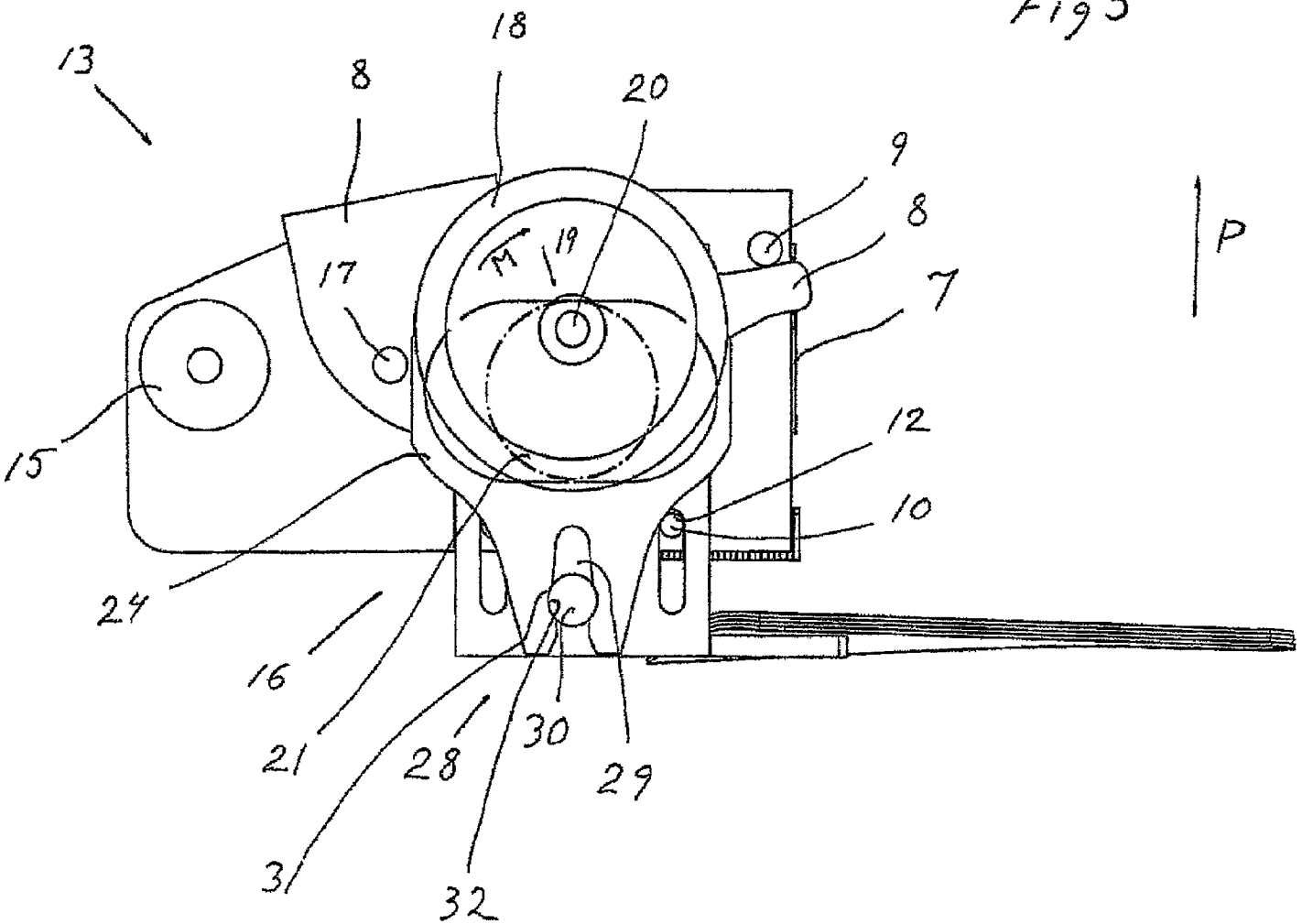
FIGS. 5-7 are schematic views of a stapler according to the present invention, in which the drive arrangement incorporated in the stapler is made clear.
Figure 6:
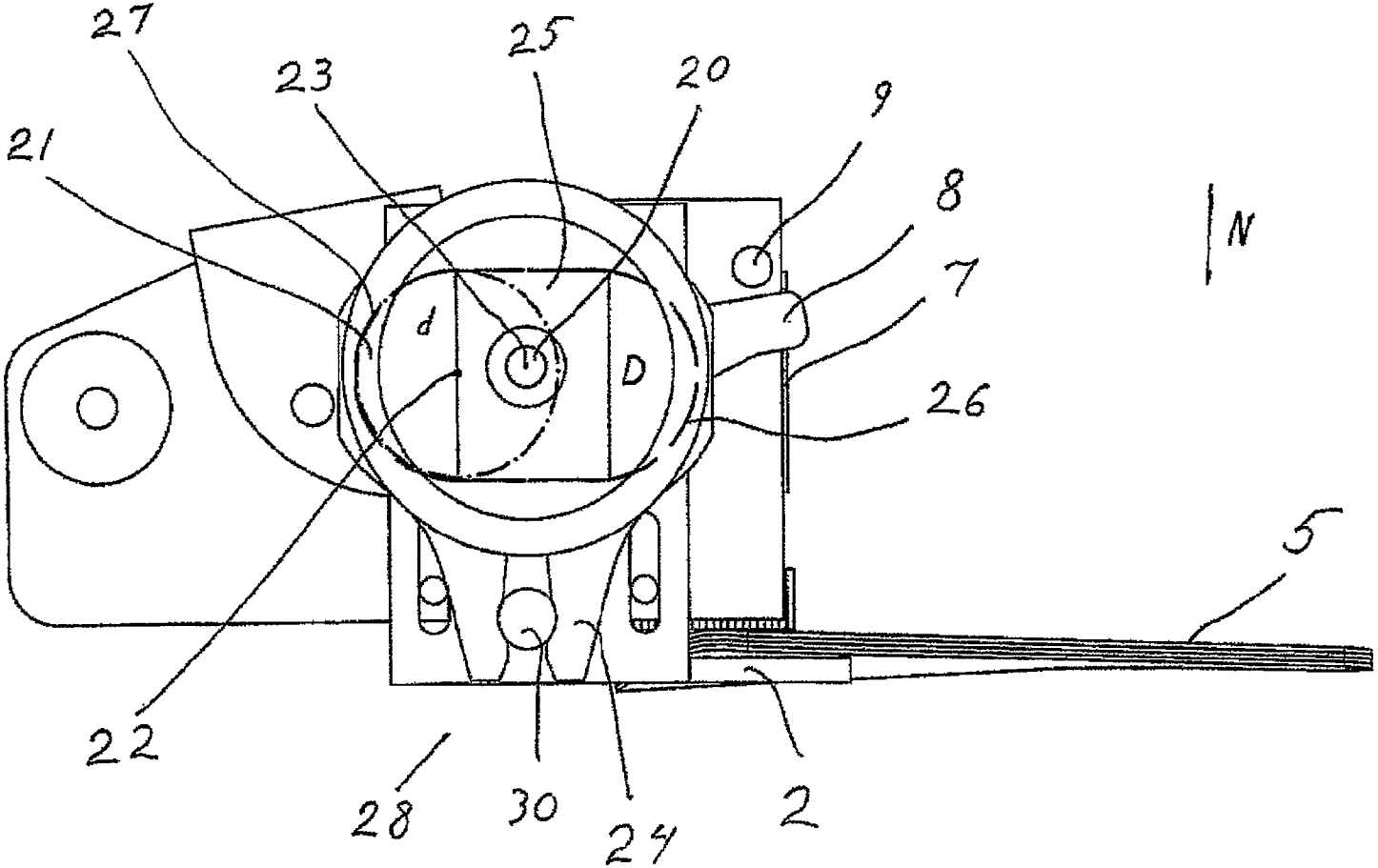

When the stapling movement has reached the second turning point, the flywheel is rotated a further half-turn and the stapler then performs a return stroke in a direction indicated by the arrow R and thereby resumes the position depicted in FIG. 5 and the stapled workpiece can be removed from the stapler.

Figure 8:
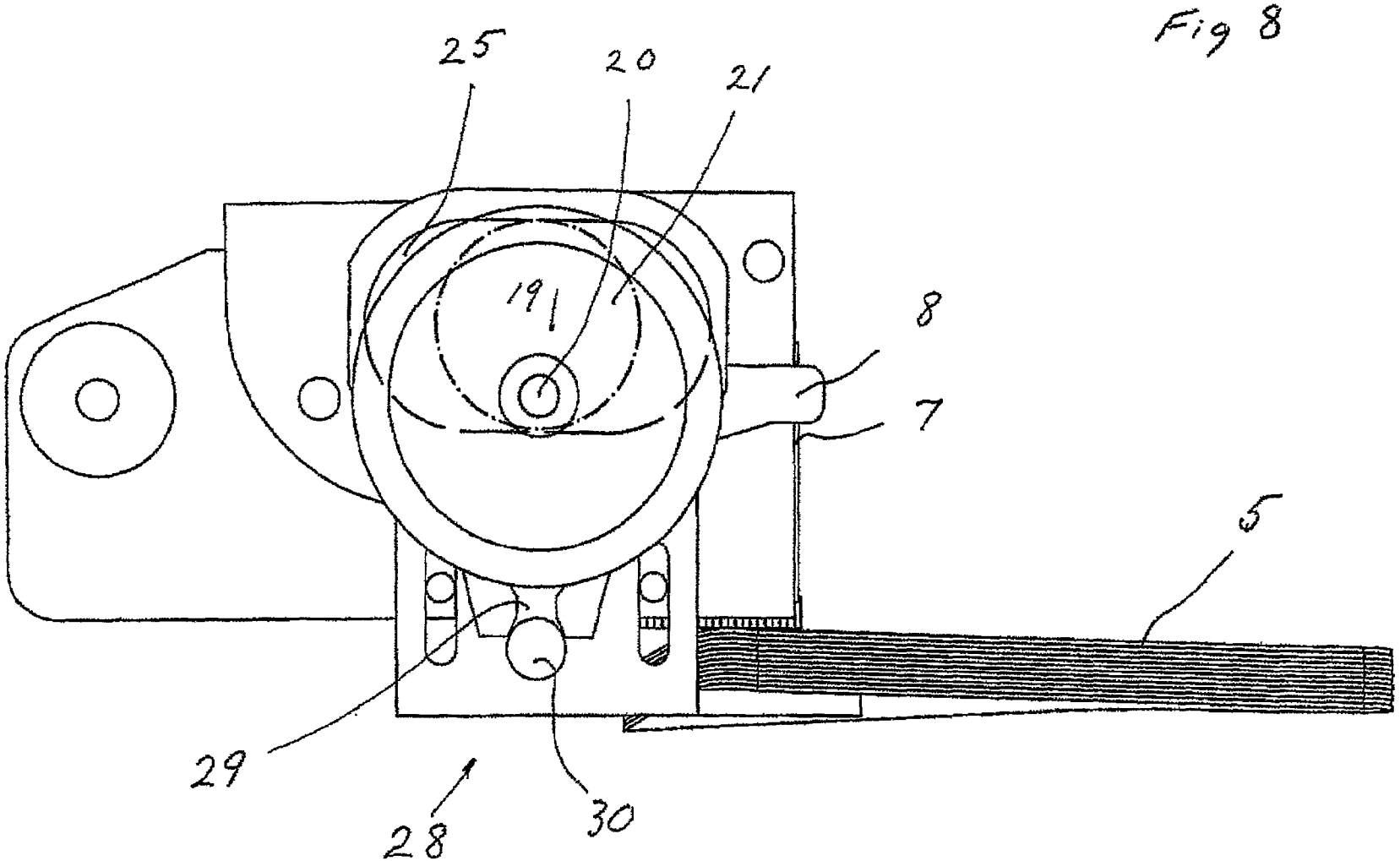
FIG. 8 is a view which corresponds to FIGS. 5-7 and in which the drive arrangement incorporated in the stapler is at a position in which an incorporated coupling is not in effective connection.
Figure 9:
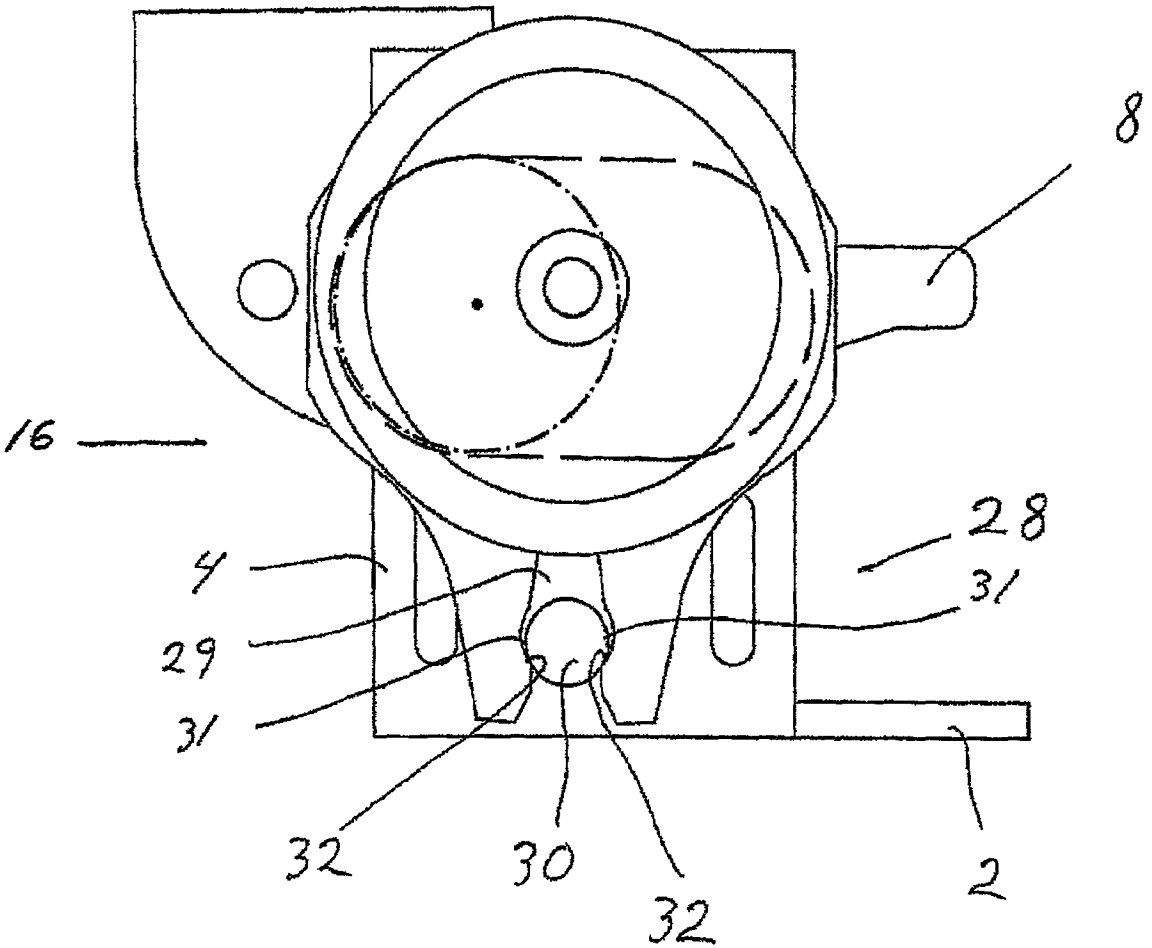
FIGS. 9-12 depict a sequence which shows in detail how a coupling incorporated in the invention changes from a position where its connection is effective to a position where the connection is ineffective.
Figure 10:
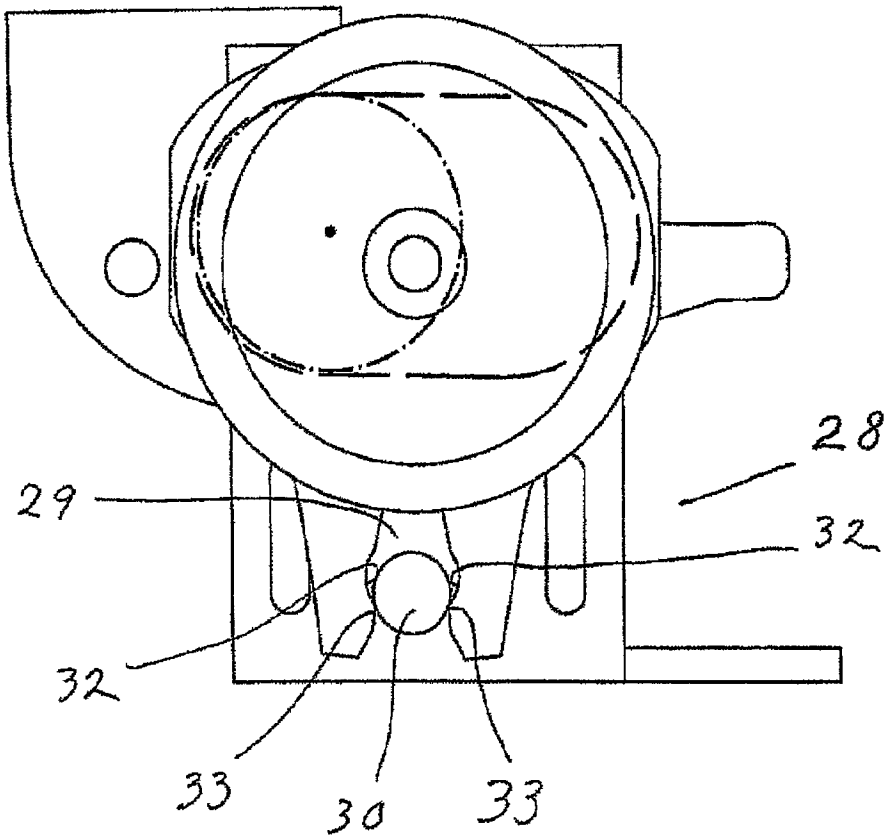
Figure 11:
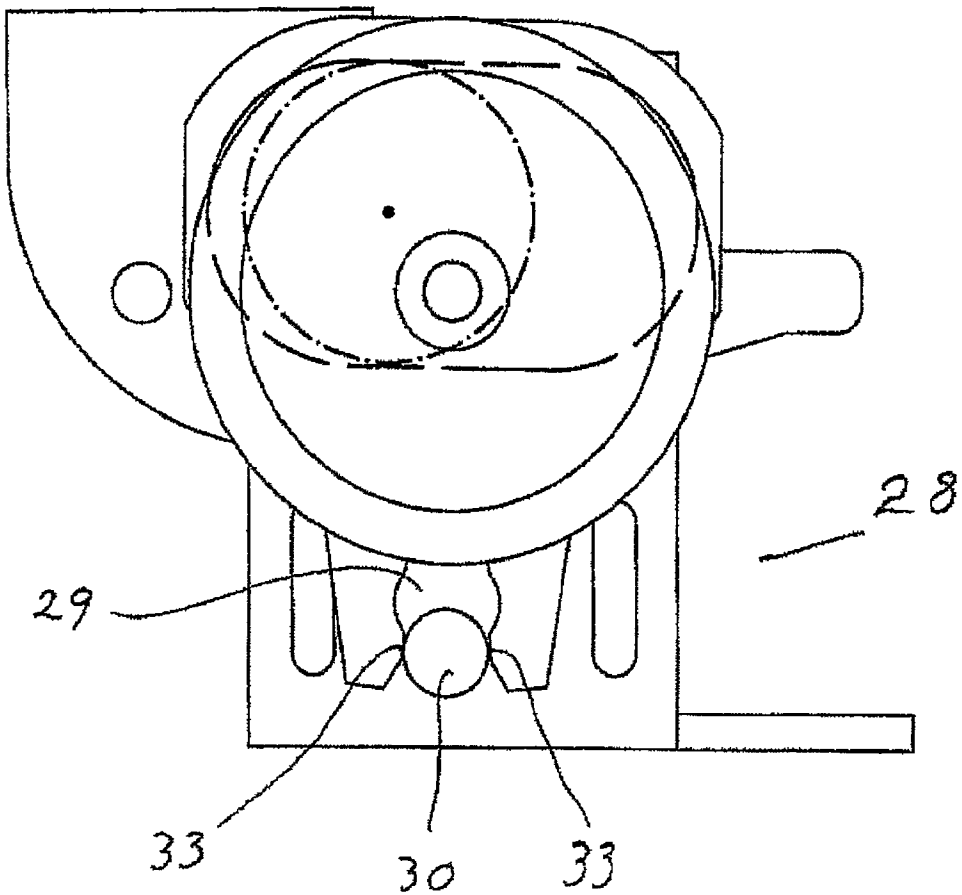
Figure 12:
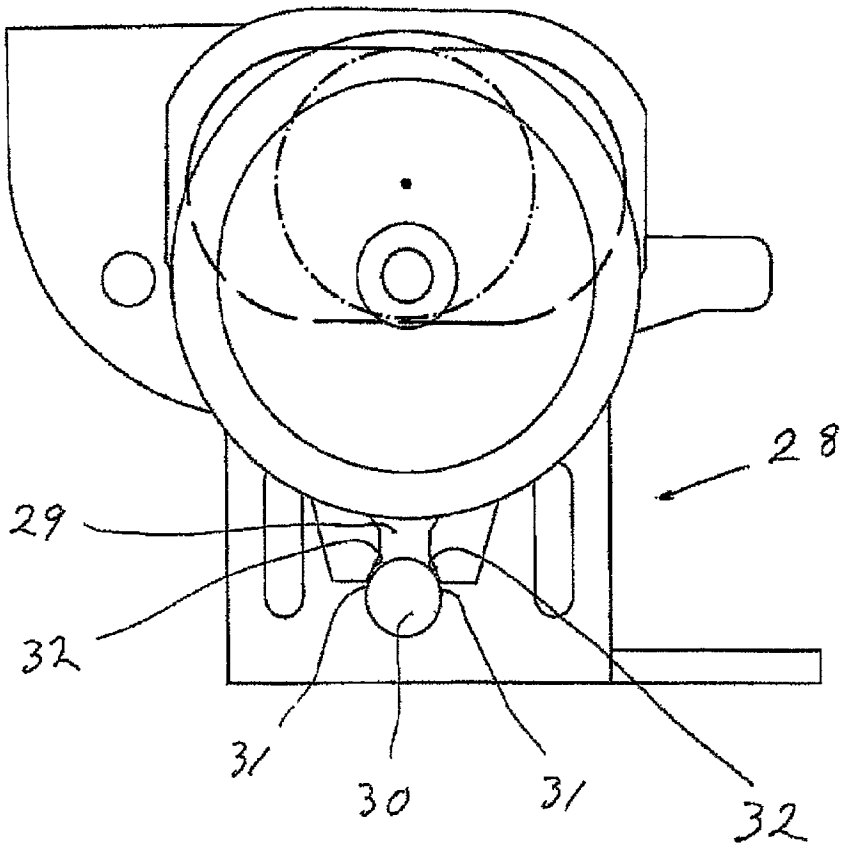

In cases where the stapler in the course of the driving stroke cannot reach the second turning point, which may happen if the workpiece is too thick, the coupling 28 loses its effective connection in the driving stroke direction, i.e. the connection which obtains when the stapler is in the situation depicted in FIG. 8 and which is explained in detail below with reference to FIGS. 9-12, which depict in a number of situations the function of the coupling 28 in the course of a stapling movement in which the driving stroke cannot reach the second turning point. These drawings depict only the parts essential to understanding the function of the coupling, which parts comprise the base part 2, the connecting means 4, the drive arm 8, the activating arrangement 16 and the spigot 30. The spigot 30 is provided with first coupling surfaces 31, and the recess 29 is provided with second coupling surfaces 32. At a first engaged position most clearly depicted in FIGS. 5-7, these surfaces are in mutual engagement in such a way that in the course of a stapling movement there is effective connection between them. The coupling surfaces 32 are provided, along their longitudinal extent, with protrusions 33, FIG. 10, which ensure that there is between the coupling surfaces 31 and 32 effective connection in the course of the stapling movement when the surfaces are at the first engaged position. FIGS. 9-12 depict the stapler during a sequence at a position in which, because of an overdimensioned workpiece not depicted in the drawings, the driving stroke cannot reach the second turning point and the couplings 19,28 are consequently not at the second extreme position and, as may be seen in the drawings, the recess 29 widens, with the result that the protrusions 33 also move apart and the spigot 30 passes the protrusions 33 as the activating arrangement continues the driving stroke to a second engaged position, depicted in FIG. 12, in which there is between the coupling surfaces 31,32 no effective connection in the driving stroke direction. The drawings show the spigot 30 being allowed to pass to the second position by the fact that the sides of the recess are elastically flexible and move apart, with the result that the protrusions are likewise parted, but it is obvious to one skilled in the art that the invention also works if the protrusions are themselves elastically flexible. At the second engaged position, however, there is effective connection between the surfaces 31, 32 when the stapler performs the return stroke.

Figure 13:
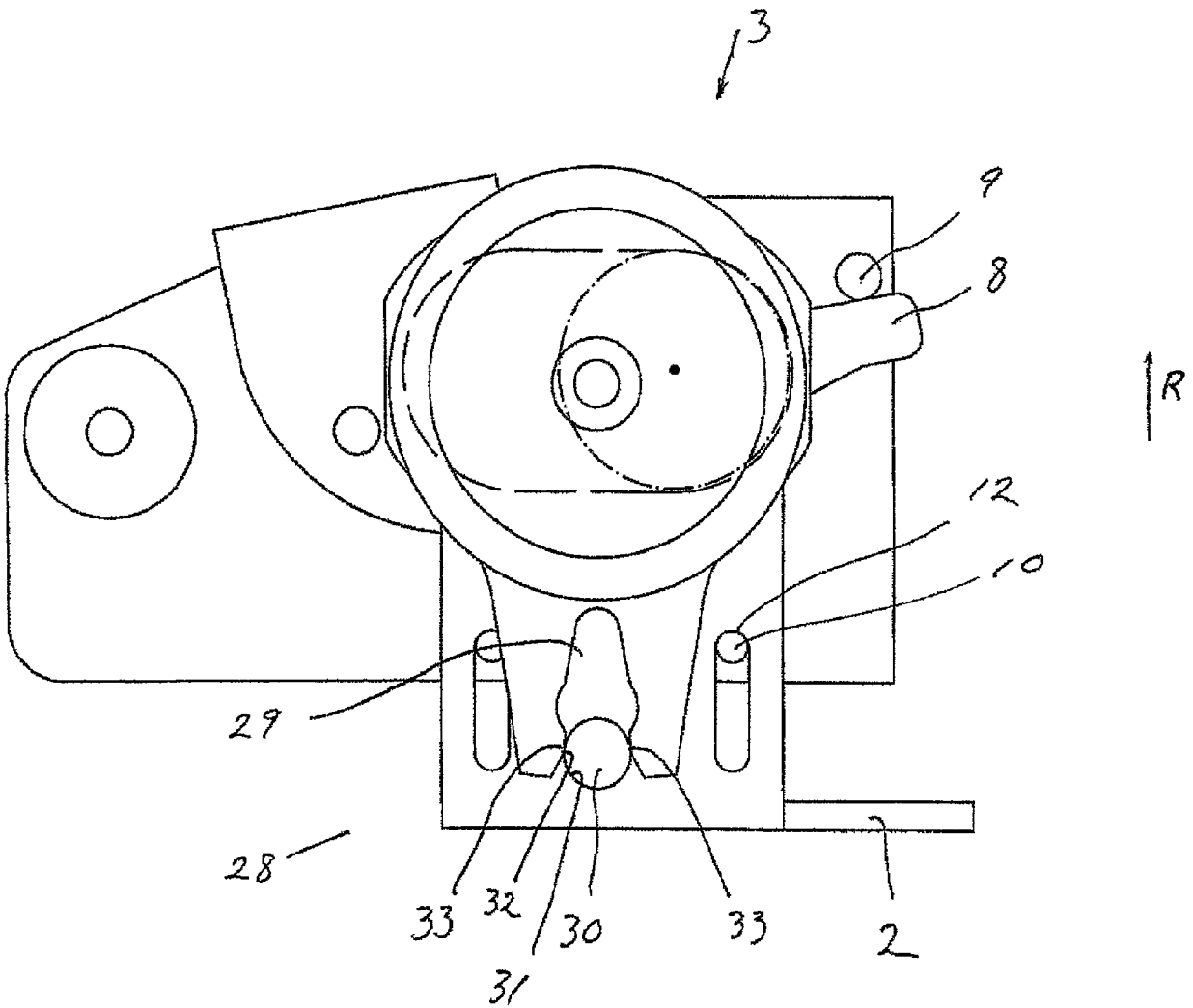
FIGS. 13-15 depict a sequence in which the coupling is brought back to an effective position.
Figure 14:
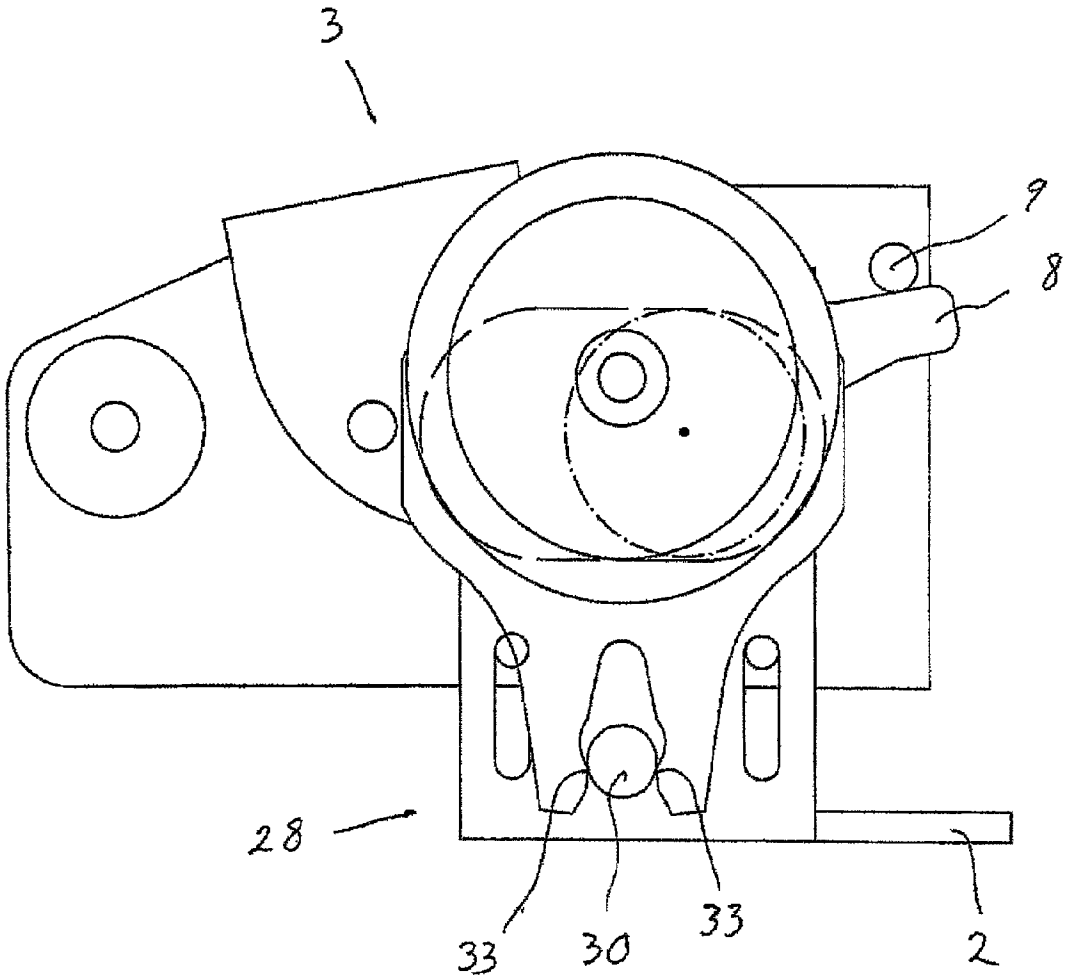
Figure 15:
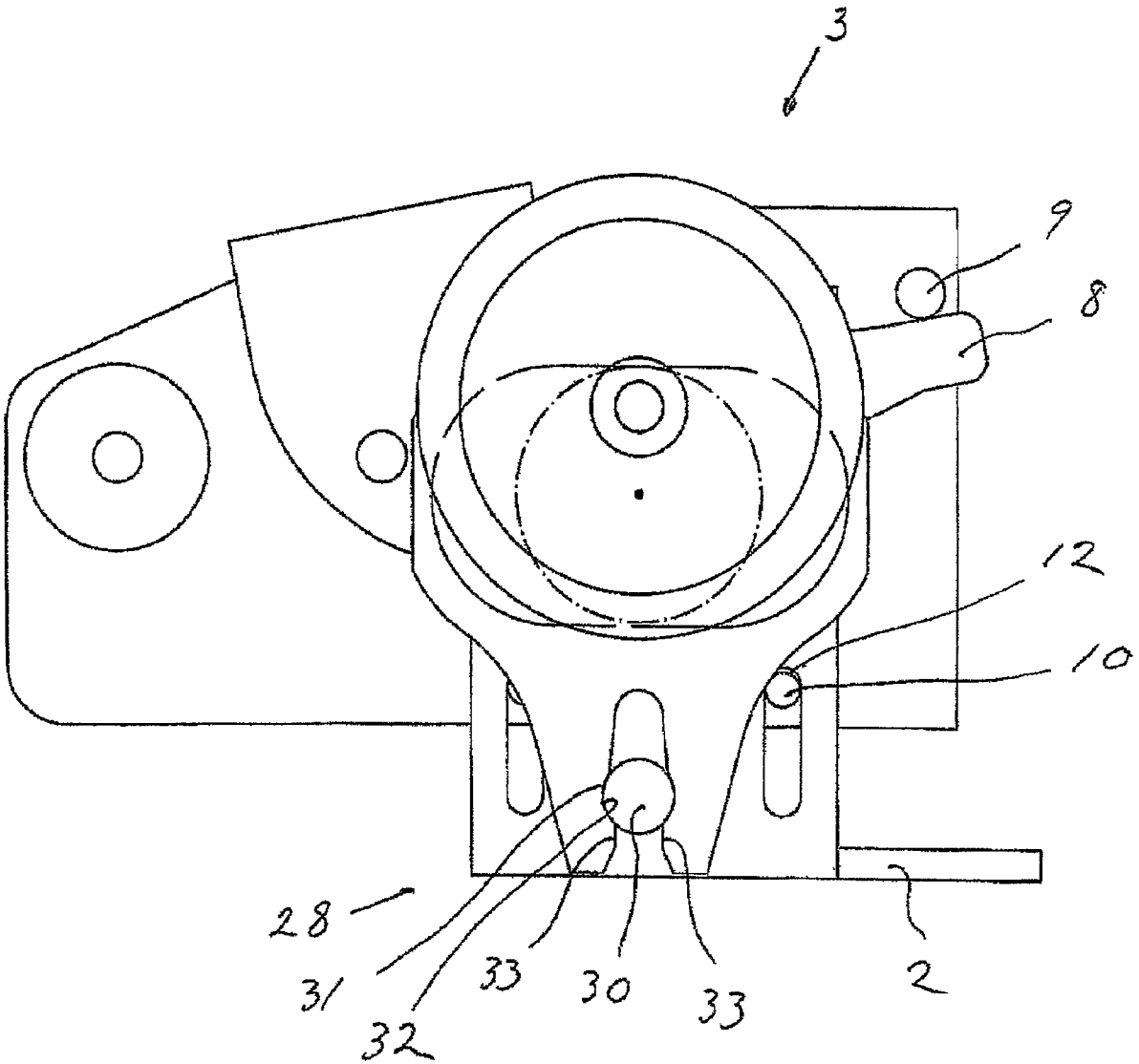

FIGS. 13-15, which are schematic views in which the stapling head 3 also appears, depict the stapler in a situation in which the activating arrangement in the course of a return stroke has moved the stapler to the first turning point. During this return stroke, the coupling surfaces are at the second position, in which there is no effective connection between them when the stapler is driven in the driving stroke direction, but there is such connection in the return stroke direction.

As may be seen in the drawings, the stapler is thus locked at the return point by the interaction between the boss 10 and the long hole 11 and between the boss 9 and the arm 8. When the return stroke has reached this locked position, the protrusions 33 give way in the same manner as at the second turning point and the surfaces 31, 32 move to the first position where the couplings 19, 28 are at the first extreme position, in which there is effective connection between the surfaces 31, 32 throughout the stapling movement.

The invention claimed is:

1. A stapler for stapling a workpiece, comprising a base part for supporting the workpiece and a stapling head connected to the base part in a manner that permits the stapling head and the base part to move toward and away from one another in a reciprocating stapling movement that has a first point in the movement at which the stapling head and the base part are remote from one another and a second point in the movement at which the stapling head and the base part are closer to one another, wherein the stapling head accommodates staples and has a staple driver supported for sliding in the direction of stapling movement for driving a staple into the workpiece, wherein the stapler comprises an activating mechanism supported on the base part, which, in the course of a driving stroke that is part of the stapling movement, drives the stapling head and the base part toward one another to bring the stapling movement from a starting point to the second point, at which the stapling head and the base part are at their shortest distance from one another and are in clamping contact with the workpiece, wherein, during the driving stroke, a staple is driven into the workpiece, after which a return stroke is performed back to the starting point, wherein the activating mechanism includes a first coupling and a second coupling, each coupling having a pair of cooperable parts adapted to form an effective connection between its parts, and wherein the activating mechanism operates so that the first coupling moves toward the second coupling and the base part, whereby the distance between the first and second couplings is reduced during the stapling movement from a first extreme position in which the stapling movement is at the first point, to an opposite second extreme position, in which the stapling movement is at the second point, wherein the second coupling is a releasable coupling constructed so that the effective connection between its parts is releasable and so that, in the course of the stapling movement, it loses its effective connection if the driving stroke is prevented from reaching the second point because of excess thickness of the workpiece, and wherein the parts of the releasable coupling comprise first coupling surfaces of one of its parts immovably fixed to the base part and second coupling surfaces of the other of its parts movable with respect to the first coupling surfaces and the base part.

2. A stapler according to claim 1, wherein the releasable coupling resumes its effective connection from the start of the return stroke.

3. A stapler according to claim 1, wherein the releasable coupling resumes its effective connection when the return stroke reaches the first turning point.

4. A stapler according to claim 1, wherein the first and second coupling surfaces engage one another in such a way that at a first position they form an effective connection through the course of the driving stroke and at a second position they lack such a connection, wherein a flexible latch is disposed at a latch position between the first and second positions, and wherein engagement of the first and second coupling surfaces changes from the first position to the second position as a result of the coupling surfaces passing the latch if the driving stroke cannot reach the second turning point.

5. A stapler according to claim 1, wherein the first coupling surfaces are arranged on a spigot immovably fixed with respect to the base part, and the second coupling surfaces are spigot-contacting surfaces of an elongate slot arranged in a drive link that is part of the activating mechanism.

6. A stapler according to claim 1, wherein the loss of the effective connection of the releasable coupling occurs in the driving stroke direction; and wherein the effective connection of the releasable coupling resumes when the stapling movement turns into the return stroke direction.

* * * * *